US009481009B2

(12) United States Patent
Evans

(10) Patent No.: US 9,481,009 B2
(45) Date of Patent: Nov. 1, 2016

(54) SYSTEM AND METHOD FOR APPLICATION OF A SURFACE COMPOUND

(71) Applicant: Lisa Marie Evans, Chandler, AZ (US)

(72) Inventor: Lisa Marie Evans, Chandler, AZ (US)

( * ) Notice: Subject to any disclaimer, the term of this patent is extended or adjusted under 35 U.S.C. 154(b) by 0 days.

(21) Appl. No.: 15/054,825

(22) Filed: Feb. 26, 2016

(65) Prior Publication Data

US 2016/0184860 A1 Jun. 30, 2016

Related U.S. Application Data

(63) Continuation of application No. 14/334,607, filed on Jul. 17, 2014, now Pat. No. 9,272,305.

(60) Provisional application No. 61/847,943, filed on Jul. 18, 2013.

(51) Int. Cl.

| | |
|---|---|
| ***B05C 17/10*** | (2006.01) |
| ***B05D 1/26*** | (2006.01) |
| ***B05C 17/005*** | (2006.01) |
| ***B05D 1/40*** | (2006.01) |
| ***B05D 5/00*** | (2006.01) |

(52) U.S. Cl.

CPC ... *B05C 17/00503* (2013.01); *B05C 17/00516* (2013.01); *B05C 17/00583* (2013.01); *B05C 17/00593* (2013.01); *B05C 17/10* (2013.01); *B05D 1/26* (2013.01); *B05D 1/40* (2013.01); *B05D 5/005* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,797,686 A * | 3/1931 | Homer | B65D 47/283 222/372 |
| 2,882,542 A | 4/1959 | Martin | |
| 3,036,327 A | 5/1962 | Crawford | |
| 3,076,995 A | 2/1963 | Rabelow | |
| 3,126,574 A * | 3/1964 | Fox | B05C 5/027 118/411 |
| 3,174,661 A * | 3/1965 | Speicher | B65D 47/248 222/545 |
| 3,241,174 A * | 3/1966 | Callahan | E04F 21/1655 15/235.6 |
| 3,776,645 A | 12/1973 | Walker | |
| 4,167,349 A | 9/1979 | Testa | |
| 4,222,678 A | 9/1980 | Miller | |

(Continued)

OTHER PUBLICATIONS

Amazon Home Improvements, CRL Reusable Caulk Tips & Cap by CR Laurence, http://www.amazon.com/Reusable-Caulk-Tips-CR-Laurence/dp/B0000KZYLKA.

(Continued)

*Primary Examiner* — David Walczak
(74) *Attorney, Agent, or Firm* — Michelle L. Gross, P.C.

(57) ABSTRACT

A compound delivery applicator comprising a substantially conical portion comprising a first end configured to couple to a compound receptacle and an applicator blade comprising a first portion extending outwardly along a longitudinal axis of and from a second end of the substantially conical portion, the first portion comprising a first side edge and a second side edge each forming an acute angle relative to the longitudinal axis of the substantially conical portion and a scraper comprising a recessed channel along an edge of the scraper. The device further comprises a substantially cylindrical hollow compound delivery channel extending along the longitudinal axis of and internally through at least a portion of the substantially conical portion, the substantially cylindrical hollow compound delivery channel further extending through the scraper of the applicator blade and configured to pass a compound therethrough and a flow control button located within the recessed channel.

5 Claims, 7 Drawing Sheets

(56) References Cited

U.S. PATENT DOCUMENTS

| | | | |
|---|---|---|---|
| 4,552,477 | A | 11/1985 | Braithwaite et al. |
| 5,496,123 | A | 3/1996 | Gaither |
| 5,661,211 | A | 8/1997 | Todd |
| 5,788,123 | A | 8/1998 | Hackmann et al. |
| 5,882,691 | A | 3/1999 | Conboy |
| 6,652,175 | B2 | 11/2003 | Chang |
| 6,739,482 | B2 | 5/2004 | Jaekel |
| 7,182,538 | B2 | 2/2007 | Grosso et al. |
| 7,338,227 | B2 | 3/2008 | Bullivant |
| 7,674,059 | B2 | 3/2010 | Daigle |
| 7,748,921 | B2 | 7/2010 | Puczkowski |
| 7,841,796 | B2 | 11/2010 | Bruggeman et al. |
| 7,854,562 | B2 | 12/2010 | Peterson et al. |
| 8,146,604 | B2 | 4/2012 | Wright et al. |
| 8,424,483 | B2 | 4/2013 | Ling et al. |
| 2010/0239356 | A1 | 9/2010 | Caulier |
| 2013/0193168 | A1 | 8/2013 | Ginter |

OTHER PUBLICATIONS

Amazon, Wood River Glue Bottle Applicator Set, http://www.amazon.com/WoodRiver-Glue-Bottle-Applicator-Set/dp/B0039ZB6ZG.

Rangate.com, Pizzi Roller spatula, http://rangate.com/specialtyproducts/pizzi_accessories.php.

The Woodworker's News and Reviews, New Glue Applicator Kit Is All-in-one Solution, http://thewoodworkersnews.com/2013/07/new-glue-applicator-kit-is-all-in-one-solution/.

True Wave, Wagner spray tech trim-it all-in-one trim tool & paint applicator, http://www.truevalue.com/product/Trim-It-All-In-One-Trim-Tool-Paint-Applicator/14694.uts.

* cited by examiner

SYSTEM AND METHOD FOR APPLICATION OF A SURFACE COMPOUND

CROSS REFERENCE TO RELATED APPLICATIONS

This document is a continuation of earlier U.S. patent application Ser. No. 14/334,607, entitled System and method for Application of a Surface Compound" to Lisa Marie Evans, which was filed Jul. 17, 2014, now U.S. Pat. No. 9,272,305, which claims the benefit of the filing date of U.S. Provisional Patent Application No. 61/847,943, entitled "Patch Delivery Systems" to Lisa Marie Evans, which was filed on Jul. 18, 2013, the disclosures of which are hereby incorporated entirely by reference herein.

BACKGROUND

1. Technical Field

Aspects of this document relate generally to systems and methods for applying viscous materials to a surface.

2. Background Art

Holes and other imperfections in walls, ceilings, floors, and other surfaces are often repaired using a compound such as a wall-patch material that is customarily applied using a semi-flexible knife and is sourced from a single-batch container that typically contains far more compound than will be used in a single application. This process typically introduces problems such as wasted compound, source contamination, and messy application thereby resulting in the user discarding unused and contaminated compound which increases the cost of such repairs due to this wasted and discarded product. The tools involved may also be unwieldy and require additional time and cost in cleaning and storing such tools for future use.

SUMMARY

Implementations of a compound delivery applicator may comprise a substantially conical portion comprising a first end configured to couple to a compound receptacle, an applicator blade coupled to the substantially conical portion, the applicator blade comprising a first portion extending outwardly along a longitudinal axis of and from a second end of the substantially conical portion, the first portion comprising a first side edge and a second side edge each forming an acute angle relative to the longitudinal axis of the substantially conical portion and a scraper coupled to the first portion distal the substantially conical portion, the scraper comprising a recessed channel along at least a portion of an edge of the scraper distal from the first portion of the applicator blade. The compound delivery applicator may further comprise a substantially cylindrical hollow compound delivery channel extending along the longitudinal axis of and internally through at least a portion of the substantially conical portion, the substantially cylindrical hollow compound delivery channel further extending through the scraper of the applicator blade and configured to pass a compound therethrough and a flow control button located within the recessed channel of the scraper.

Particular aspects may comprise one or more of the following features. The scraper may further comprise a distribution surface comprising an opening configured to pass compound from the substantially cylindrical hollow compound delivery channel therethrough. The distribution surface may form an acute angle relative to the longitudinal axis of the substantially conical portion. The recessed channel may be located on a surface of the scraper other than the distribution surface. The edge of the scraper may comprise a first edge portion and a second edge portion forming an angle with each other within a range of 90 to 120 degrees. The substantially cylindrical hollow compound delivery channel may bisect the angle formed by the first and second edge portions. The flow control button may comprise a substantially hollow passageway configured to align with the substantially cylindrical hollow compound delivery channel such that flow of a compound through the compound delivery channel is unobstructed. The flow control button may be configured to slide within the recessed channel. The flow control button may further comprise a textured surface facing outward from the recessed channel. The first end of the substantially conical portion may be threaded such that it is configured to threadably couple to the compound receptacle. The compound may be one of a wall-patch, a caulk, an adhesive, and a paint. The substantially conical portion, the applicator blade, and the substantially hollow compound delivery channel may be integrally formed. The compound receptacle may be comprised of a refillable cartridge. The compound receptacle may be comprised of a disposable cartridge. The compound delivery applicator may further comprise a removable plug configured to fit within the opening of the distribution surface such that flow of the compound is obstructed.

Implementations of a method of applying a compound using a compound delivery applicator may comprise coupling a first end of a substantially conical portion of the compound delivery applicator to a compound receptacle containing a compound, placing an applicator blade that is coupled to the substantially conical portion in contact with a surface to which the compound is to be applied, the applicator blade comprising a first portion extending outwardly along a longitudinal axis of and from a second end of the substantially conical portion, the first portion comprising a first side edge and a second side edge each forming an acute angle relative to the longitudinal axis of the substantially conical portion, dispensing the compound through a substantially cylindrical hollow compound delivery channel extending along the longitudinal axis of and internally through at least a portion of the substantially conical portion, the substantially cylindrical hollow compound delivery channel further extending through a scraper of the applicator blade coupled to the first portion distal the substantially conical portion, removing excess compound using at least a portion of an edge of the scraper distal from the first portion of the applicator blade, and actuating a flow control button located within a recessed channel along at least a portion of an edge of the scraper distal from the first portion of the applicator blade.

Particular aspects may comprise one or more of the following features. The compound receptacle may comprise a disposable cartridge. The compound may be dispensed by pressurizing the compound. The compound may be one of a wall-patch, a caulk, an adhesive, and a paint. Actuating the flow control button may comprise sliding the flow control button along the recessed channel.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventor is fully aware that she can be her own lexicographer if desired. The inventor expressly elects, as her own lexicographer, to use only the plain and ordinary meaning of terms in the specification and claims unless she clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. §112(f). Thus, the use of the words "function," "means" or "step" in the Description , Drawings, or Claims is not intended to somehow indicate a desire to invoke the special provisions of post-AIA 35 U.S.C. §112(f), to define the invention. To the contrary, if the provisions of post-AIA 35 U.S.C. §112(f) are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of post-AIA 35 U.S.C. §112(f). Moreover, even if the provisions of post-AIA 35 U.S.C. §112(f) are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or methods disclosed herein. Many additional components and assembly procedures known in the art consistent with the intended compound delivery apparatus and related methods will become apparent for use with particular implementations from this disclosure. Accordingly, for example, although particular implementations are disclosed, such implementations and implementing components may comprise any components, models, versions, quantities, and/or the like as is known in the art for such systems and implementing components, consistent with the intended operation.

The present disclosure relates to systems and methods for applying a surface compound such as by non-limiting example, wall-patch, Spackle®, putty, adhesive, caulk, paint, stain, and other similar substances.

Figure 1:
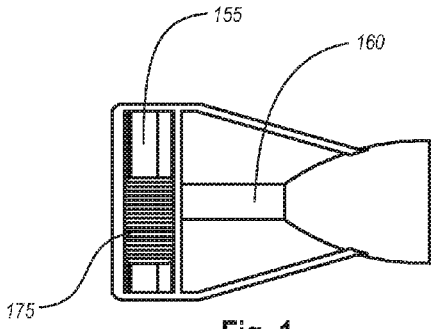
FIGS. 1-2 depict implementations of a compound delivery applicator.
Figure 2:
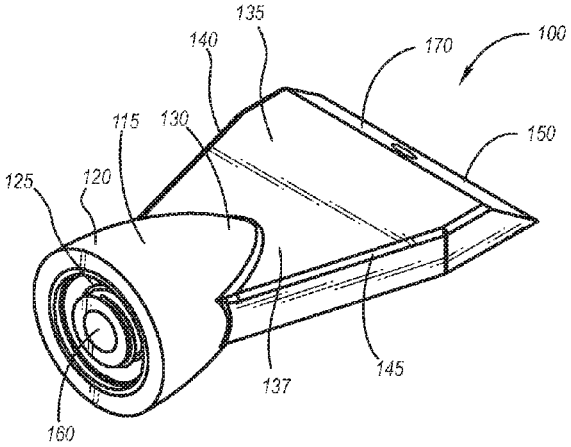
Figure 3:
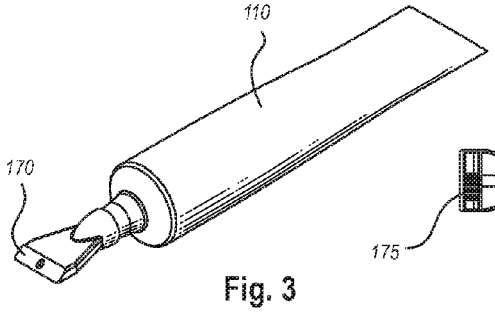
FIGS. 3-4 depict implementations of a compound delivery applicator used with a compound receptacle that comprises a tube.
Figure 4:
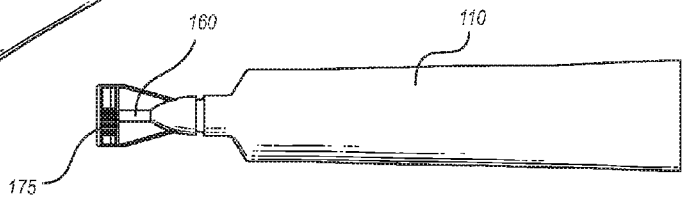
Figure 5:
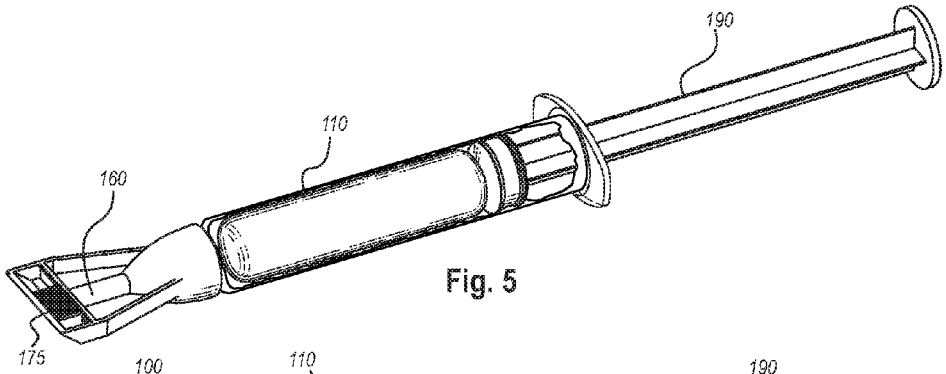
FIGS. 5-6 depict implementations of a compound delivery applicator used with a plunger-actuated compound receptacle.

FIGS. 1-2 show an implementation of a compound delivery applicator 100 for use with a tube or other compound receptacle 110, as depicted in FIGS. 3-5. Some embodiments may comprise a substantially conical portion 115 having a first end 120 configured to couple to the compound receptacle 110. While it is intended that any appropriate coupling methodology may be implemented, in some implementations, the first end 120 may comprise one or more threads 125 to threadably couple with a tube or other compound receptacle 110. In other implementations, threads may not be necessary as the applicator may slide or otherwise be non-threadably coupled to the compound receptacle.

As shown, an applicator blade 135 is coupled to a second end 130 of the substantially conical portion 115 of the compound delivery applicator 100. The applicator blade 135 comprises a first portion 137 that extends outwardly from the second end 130 of the substantially conical portion 115 and along a longitudinal axis of the substantially conical portion 115. First and second side edges 140, 145 extend outward from the second end 130 of the conical portion each forming an acute angle relative to the longitudinal axis of the substantially conical portion 115. A scraper 150 is coupled to the first portion 137 of the applicator blade 135 at a location that is distal from the substantially conical portion 115. In some implementations, the scraper 150 may comprise a recessed channel 155 located on a surface of the scraper as depicted in FIGS. 1 and 4-5 at a location that is distal from the substantially conical portion 115 and the first portion 137 of the applicator blade 135. The recessed channel 155 may run along substantially the entire scraper edge or along any portion of the scraper edge.

Figure 6:
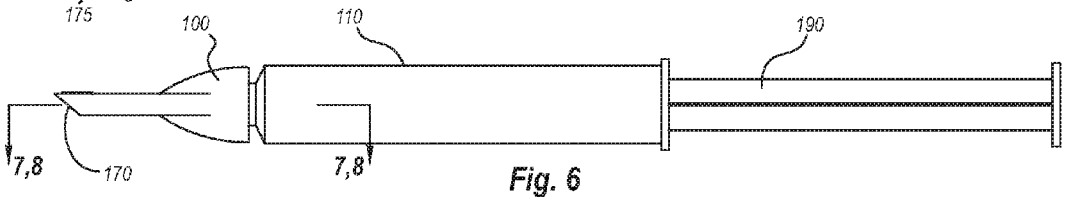
Figure 7:
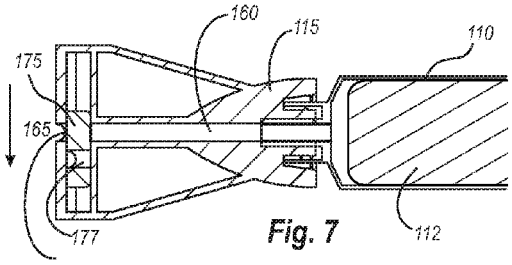
FIGS. 7-8 depict a cross-sectional view of an implementation of a compound delivery applicator comprising a slidable flow control button.
Figure 8:
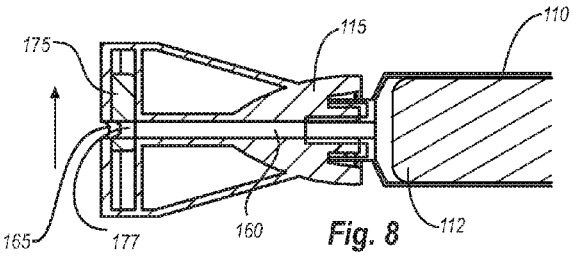

FIGS. 7 and 8 provide a cross-sectional view of an implementation of a compound delivery applicator 100 as shown in FIG. 6. A substantially cylindrical hollow compound delivery channel 160 extends longitudinally through at least a portion of the substantially conical portion 115, applicator blade 135, and/or scraper 150 such that a compound held in the compound receptacle 110 to which the applicator 100 is coupled may pass through the compound delivery channel 110 and be applied to a surface as the compound exits the opening 165 in the scraper 150.

In some implementations, as shown in FIGS. 2-3 and 6, the scraper 150 further comprises a distribution surface 170 which allows compound to pass from the compound delivery channel 160 and through an opening 165 in the distribution surface 170 for application to a wall, floor, or other appropriate surface to which application of the compound is desired. In some embodiments, the recessed channel 155 is located on a surface of the scraper 150 other than the distribution surface 170. While it is contemplated that the distribution surface 170 may be configured to have any angle that is desirable for easing of use in applying the compound, in some embodiments, it may be preferable to orient the distribution surface 170 such that it forms an acute angle relative to the longitudinal axis of the substantially conical portion 115 of the applicator. It should be noted that terms such as underside, top, underneath, etc. are used for descriptive purposes with reference to the orientation and views depicted in the figures and are not intended to limit the orientation of the applicator when in use. One of ordinary skill in the art would recognize that the applicator may be more easily and effectively used in different orientations relative to the surface to which the compound is being applied depending on the angular orientation of and the type of surface (e.g. vertical wall, horizontal ceiling, etc.).

Figure 9:
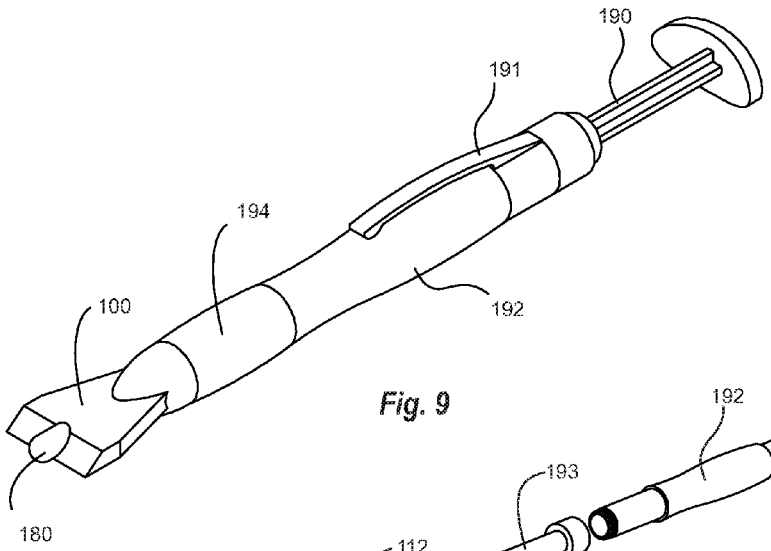
FIGS. 9-10 depict implementations of a compound delivery applicator used with a spring-actuated plunger.
Figure 10:
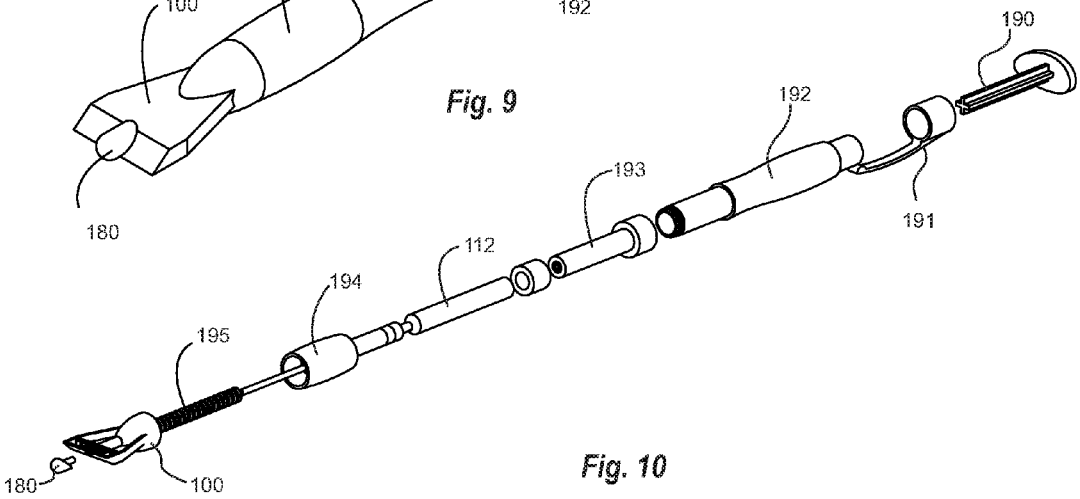
Figure 11:
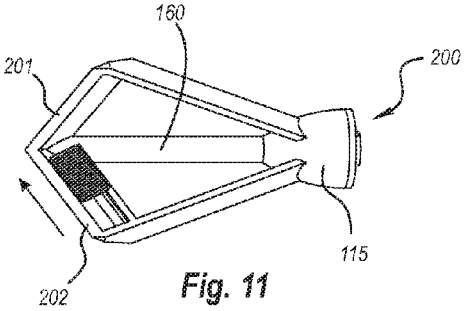
FIGS. 11-14 depict implementations of a compound delivery applicator comprising a scraper with a plurality of edge portions for use at an abutment of two surfaces.
Figure 12:
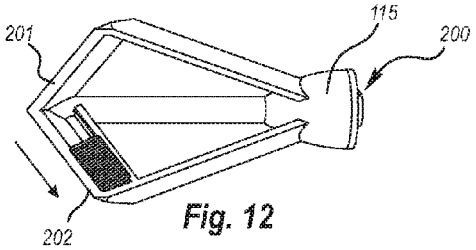

Some embodiments of the compound delivery applicator 100 may further comprise a flow control button 175 that allows a user to control flow of the compound by allowing the compound to flow freely from the opening 165 in the scraper 150 when the flow control button 175 is in an open position and prevent compound from flowing through the opening 165 when the flow control button 175 is in the closed position. The flow control button 175 may be located within the recessed channel 155 of the scraper 150 and may slide or otherwise move within the recessed channel 155 to control the flow of compound application. As shown in FIGS. 7 and 8, the flow control button 175 may comprise a channel, opening, or other hollow passageway 177 that aligns with the substantially cylindrical hollow compound delivery channel 160 and the opening 165 in the scraper 150 such that when the flow control button 175 is slid or otherwise located in an open position in the recessed channel 155 as shown in FIG. 8, the hollow passageway 177 couples with the substantially cylindrical hollow compound delivery channel 160 and the opening 165 in the scraper 150 to form a continuous pathway for the compound to flow through. The flow control button 175 may also be slid or otherwise positioned into a closed position as shown in FIG. 7 such that the hollow passageway 177 does not align with the substantially cylindrical hollow compound delivery channel 160 and opening 165 in the scraper 150 thereby obstructing the flow of the compound. Alternatively, as shown in FIGS. 9-10, flow of compound may be obstructed by inserting a plug 180 or other stopper into the opening located on the distribution surface 170 of the scraper 150. To increase the ease with which a user may slide or otherwise move the flow control button 175, a texture such as ridges, bumps, depressions, or any other suitable texture or pattern may be present on the outward-facing surface of the flow control button 175.

While some implementations of the compound delivery applicator may comprise a scraper 150 having a single edge portion that is flat and uniform for use in applying compound to a flat surface such as depicted in FIGS. 1-8, for some applications, such as applying compound to a corner or other abutment of two surfaces, it may be preferable that applicator 200 has a scraper 150 that comprises a plurality of edge portions to aid the user in smoothly applying the compound. For example, as shown in FIGS. 11-18, the scraper may comprise a first edge portion 201 and a second edge portion 202 that meet a juncture to form an edge that is more suitable for applying compound to a corner. While the first and second edge portions may be configured to form any suitable angle, it may be preferable that the first and second edge portions form an angle that is within a range of 90 to 120 degrees relative to each other for use in corners or other application in which two flat surfaces meet at a right angle. In some embodiments, an angle of approximately 111 degrees may be preferable; however this angle may differ as needed depending on the various dimensions and angles of other portions of the applicator and/or applicator blade.

Figure 13:
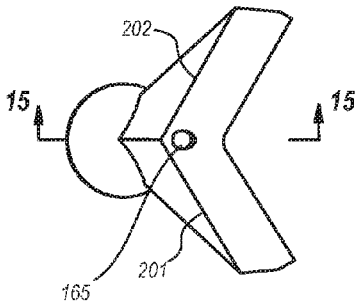
Figure 14:
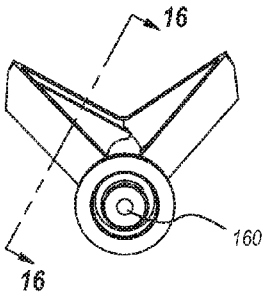

FIGS. 13-14 provide end views of the compound delivery applicator 200 having first and second scraper edge portions 201, 202 that meet at approximately an angle within a range of 90 to 120 degrees relative to each other. For embodiments comprising a distribution surface 170, while any appropriate angle may be used, it may be preferable to enhance ease of scraping and leveling the compound being applied to orient one or more distribution surfaces corresponding to the first and/or second scraper edge portions at an angle that is acute relative to the longitudinal axis of the substantially conical portion. In some embodiments, it may be advantageous to locate the substantially cylindrical hollow compound delivery channel 160 such that it substantially bisects the angle formed by the first and second scraper edge portions. As shown in FIG. 13, in some implementations, the opening 165 in the distribution surface 170 that is coupled to the substantially cylindrical hollow compound delivery channel 160 may be located proximal to an edge of the distribution surface, however, it is intended that this opening 165 be located anywhere along the distribution surface 170 that is appropriate for ease of use in applying compound using the applicator.

Figure 15:
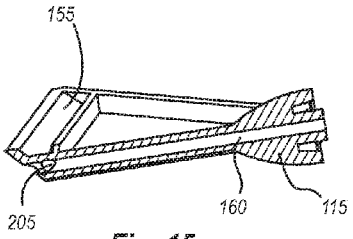
FIGS. 15-16 depict a cross-sectional view of implementations of a compound delivery applicator comprising a plurality of scraper edge portions.
Figure 16:
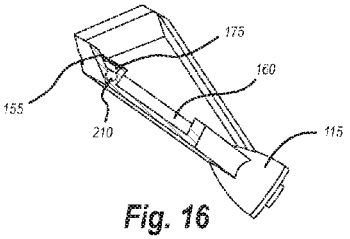
Figure 17:
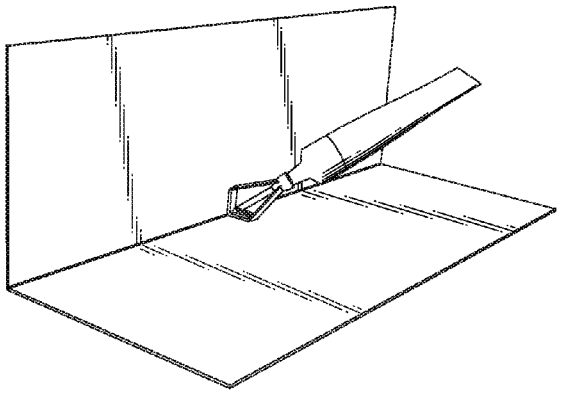
FIGS. 17-19 depict implementations of a compound delivery applicator in use at an abutment of two surfaces and in conjunction with a compound receptacle.
Figure 18:
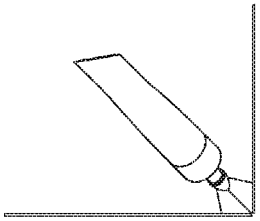
Figure 19:
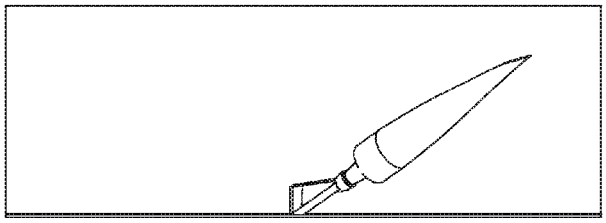

Additionally as shown, the applicator 200 may further comprise a recessed channel 155 running along at least a portion of one or more scraper edge portions 201, 202 distal from the substantially conical portion 115. While it is contemplated that the recessed channel 155 may be located on either surface of the scraper 150, in some implementations, it may be preferable to located the channel 155 on an opposite surface from that on which the opening 165 in the distribution surface 170 is located for ease of operation of a flow control button 175 that may be located in the recessed channel 155. The flow control button 175 may be slidably operated by moving the flow control button 175 within the recessed channel 155 between and open and closed position to control the flow of the compound being applied. Some embodiments may utilize a similar flow control button structure as the single edge-portion embodiment of the applicator in which the flow control button 175 comprises a hollow portion 177 configured to align with the substantially cylindrical hollow compound delivery channel 160 and the opening 165 in the distribution surface 170. Due to the angled design of the scraper edge portions in this embodiment, however, in some implementations, it may be preferable to utilize a flow control button 175 that is structured such that at least a portion of the flow control button obstructs the substantially cylindrical hollow compound delivery channel when it is placed in a closed position that is aligned with the substantially cylindrical hollow compound delivery channel 160. Alternatively, when the flow control button is slid or otherwise located within the recessed channel 155 in an open position, the flow control button 175 does not obstruct the flow of compound through the substantially cylindrical hollow compound delivery channel 160. To accomplish this, the flow control button 175 may comprise a protrusion 210 extending outward from the flow control button such that the protrusion 210 at least partially obstructs the substantially cylindrical hollow compound delivery channel when in the closed position. As depicted in FIGS. 15-16, the substantially cylindrical hollow compound delivery channel may comprise one or more openings 205 within the recessed channel to accommodate such a protrusion 210 or other portion of the flow control button 175 that is used to impede compound flow.

FIGS. 20-24 depict implementations of a compound delivery applicator 300 designed for use with compounds such as for example, paint, stain, or adhesive, that may be easily distributed and applied using a roller. As shown, the substantially cylindrical hollow compound delivery channel 160 may open into a roller channel 310 that is configured to allow the accumulated compound to contact a surface of a roller 330 when the roller is coupled via one or more roller brackets 320 which may be located on either end of the roller channel 310. Similar to other embodiments of a compound delivery applicator described herein, the applicator blade may comprise a first portion comprising first and second side edges 140, 145 each forming an acute angle relative to the substantially conical portion 115 through which the substantially cylindrical hollow compound delivery channel 160 passes.

Figure 21:
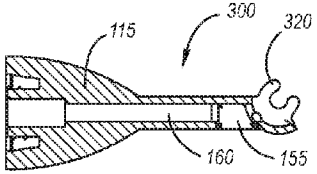
FIGS. 20-24 depict implementations of a compound delivery applicator comprising a roller.
Figure 20:
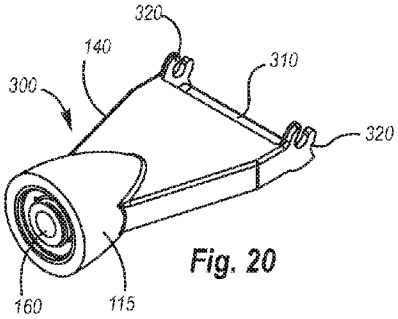
Figure 22:
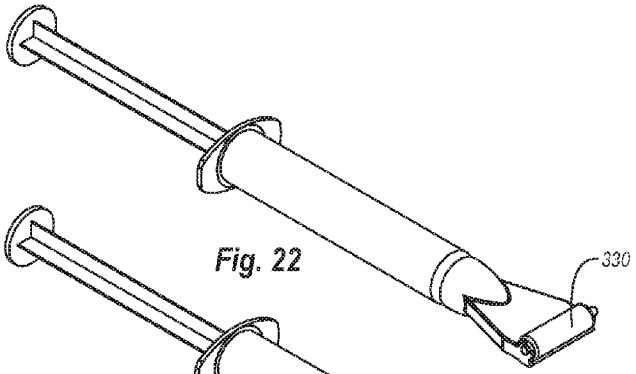
Figure 23:
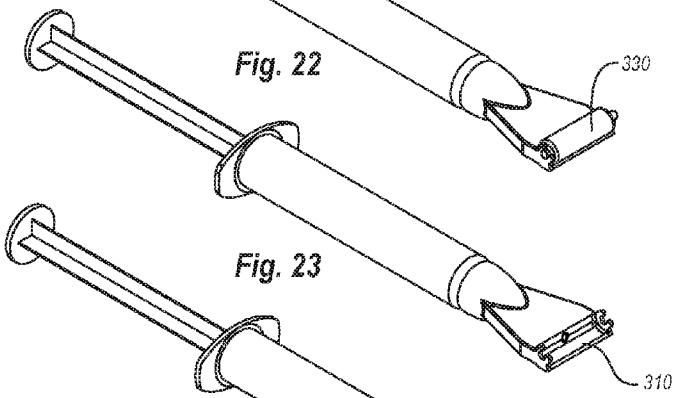
Figure 24:
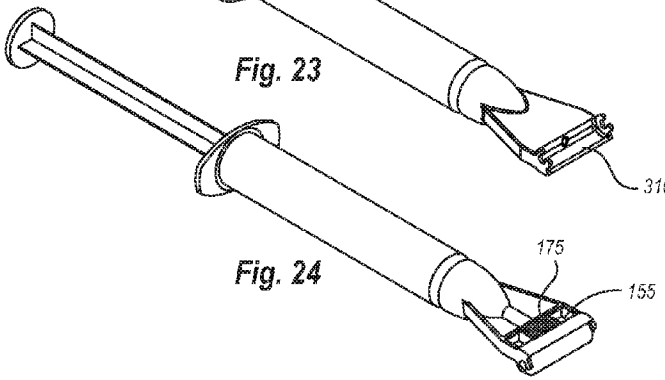

In some implementations as shown in FIGS. 21 and 24, the compound delivery applicator 300 may further comprise a recessed channel 155 located substantially adjacent to the roller channel 310. The recessed channel 155 may be configured to house a flow control button 175 therein, which may slidably move along the recessed channel 155 to obstruct or allow flow of the compound as desired by the user. It is contemplated that the flow control button 175 may have any such characteristics or features as described above and related to the other embodiments of a compound delivery applicator described herein.

Any of the embodiments of a compound delivery applicator contemplated by this disclosure may comprise one or more threads 125 to threadably couple to a compound receptacle 110. Alternatively, some embodiments may slide onto or slidably mate with a compound receptacle 110 such as an existing tube of compound such as caulk or wall-patch. In some embodiments, the compound receptacle 110 may comprise a disposable or refillable cartridge 112, as shown in FIGS. 7-8 which may be housed inside the compound receptacle 110 and may be replaced or refilled after use.

It is intended that the compound be dispensed by applying a pressure to the compound inside the compound receptacle 110 which may be accomplished by a user squeezing a compound receptacle 110 that is comprised of a flexible material, such as for example, a tube. Alternatively a plunger 190 may be used in conjunction with a spring 195 or other pressurizing device to apply a pressure to the compound within the compound receptacle 110 and/or cartridge 112. Such a plunger 190 may also be used in a syringe-like configuration to draw viscous compound into the compound receptacle 110. In some embodiments, the compound delivery applicator may be coupled to a pen-like or syringe-like body as shown in FIGS. 9-10 which may comprise any appropriate configuration of components such as a plunger 190, a piston advance body 193, an advancing piston or spring 195, a cartridge 112, a clip 191, a body 192, and a grip portion 194.

While it is intended that any number of the components comprising the compound delivery applicator, compound receptacle, plunger, etc. may be comprised of separately manufactured and assembled parts, some implementations may also be integrally formed so as to provide manufacturing efficiencies. It is contemplated that any of the components described in this disclosure may be comprised of any synthetic material, polymer, plastic, or any other suitable material that may be desired to be used in such implementations.

Figure 25:
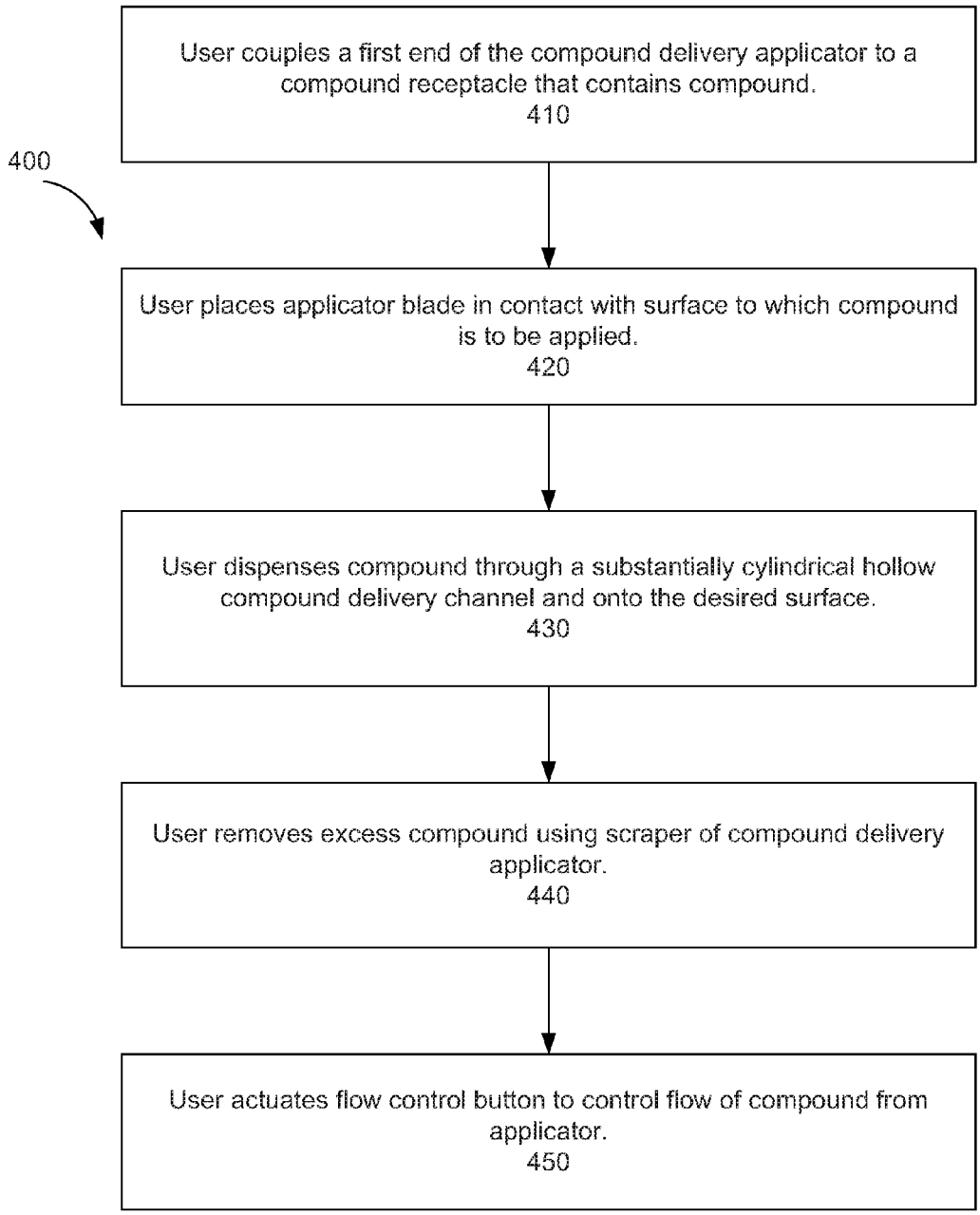
FIG. 25 is a block diagram of a method of applying a compound using a compound delivery applicator.

FIG. 25 provides a block diagram of a method of applying a compound 400 using an implementation of a compound delivery applicator in accordance with the above disclosure. When a user has identified a surface to which the user desires to apply a compound, the user may coupling a first end of a substantially conical portion of the compound delivery applicator to a compound receptacle containing a compound 410. The compound receptacle may further comprise a cartridge that may be disposable or refillable for multiple uses. The user may then place an applicator blade that is coupled to the substantially conical portion of the compound delivery applicator in contact with a surface to which the compound is to be applied 420. The applicator blade may comprise a first portion extending outwardly along a longitudinal axis of and from a second end of the substantially conical portion and the first portion may comprise a first side edge and a second side edge each forming an acute angle relative to the longitudinal axis of the substantially conical portion. The user may then dispense the compound through a substantially cylindrical hollow compound delivery channel extending along the longitudinal axis of and internally through at least a portion of the substantially conical portion 430, the substantially cylindrical hollow compound delivery channel further extending through a scraper of the applicator blade coupled to the first portion distal the substantially conical portion. Once the compound has been applied and smoothed on the desired surface, the user may remove the excess compound using at least a portion of an edge of the scraper distal from the first portion of the applicator blade 440. The user may also actuate a flow control button 450 that is located within a recessed channel along at least a portion of an edge of the scraper distal from the first portion of the applicator blade between open and closed positions to control flow of the compound through the substantially cylindrical hollow compound delivery channel to prevent drying of the compound within the compound receptacle when the applicator is not in use.

It will be understood that embodiments and implementations described and illustrated herein are not limited to the specific components disclosed herein, as virtually any components consistent with the intended operation of a method and/or system implementation for compound application may be utilized. In places where the description above refers to particular embodiments of a compound delivery applicator and application techniques, it should be readily apparent that a number of modifications may be made without departing from the spirit thereof and that these implementations may be applied to other such systems and components. The presently disclosed implementations are, therefore, to be considered in all respects as illustrative and not restrictive.

The implementations listed here, and many others, will become readily apparent from this disclosure. From this, those of ordinary skill in the art will readily understand the versatility with which this disclosure may be applied.

I claim:

1. A method of applying a compound using a compound delivery applicator, the method comprising:

coupling a first end of a substantially conical portion of the compound delivery applicator to a compound receptacle containing a compound;

placing an applicator blade that is coupled to the substantially conical portion in contact with a surface to which the compound is to be applied, the applicator blade comprising a first portion extending outwardly along a longitudinal axis of and from a second end of the substantially conical portion, the first portion comprising a first side edge and a second side edge each forming an acute angle relative to the longitudinal axis of the substantially conical portion;

dispensing the compound through a substantially cylindrical hollow compound delivery channel extending along the longitudinal axis of and internally through at least a portion of the substantially conical portion, the substantially cylindrical hollow compound delivery channel further extending through a scraper of the applicator blade coupled to the first portion distal the substantially conical portion;

removing excess compound using at least a portion of an edge of the scraper distal from the first portion of the applicator blade; and actuating a flow control button located within a recessed channel along at least a portion of an edge of the scraper distal from the first portion of the applicator blade.

2. The method of claim 1, wherein the compound receptacle comprises a disposable cartridge.

3. The method of claim 1, wherein the compound is dispensed by pressurizing the compound.

4. The method of claim 1, wherein the compound is one of a wall-patch, a caulk, an adhesive, and a paint.

5. The method of claim 1, wherein actuating the flow control button comprises sliding the flow control button along the recessed channel.

* * * * *